United States Patent [19]

Kern et al.

[11] 4,231,207

[45] Nov. 4, 1980

[54] HEAT-INSULATED STRUCTURAL SECTION ASSEMBLY

[75] Inventors: Horstmar Kern; Helmut Botzenhardt, both of Ulm, Fed. Rep. of Germany

[73] Assignee: Wieland-Werke Aktiengesellschaft, Ulm, Fed. Rep. of Germany

[21] Appl. No.: 967,533

[22] Filed: Dec. 7, 1978

[30] Foreign Application Priority Data

Dec. 14, 1977 [DE] Fed. Rep. of Germany ..... 2755697

[51] Int. Cl.[3] ..... E04C 3/30

[52] U.S. Cl. ..... 52/730; 49/DIG. 1

[58] Field of Search ..... 52/730–32, 52/397, 403, 398; 49/DIG. 1; 29/155 R

[56] References Cited

U.S. PATENT DOCUMENTS

| | | | |
|---|---|---|---|
| 3,823,524 | 7/1974 | Weinstein | 52/403 |
| 4,096,678 | 6/1978 | Diels et al. | 52/403 |

*Primary Examiner*—James L. Ridgill, Jr.

*Attorney, Agent, or Firm*—Ladas & Parry

[57] ABSTRACT

This invention relates to heat-insulated structural section assemblies for use in manufacturing window and door frames. There is disclosed a structural section assembly consisting of two metal structural sections having integral flanges defining opposed longitudinally extending grooves together with the webs of the respective structural metal sections, and transversely connected to each other by a pair of plastic heat-insulating bars, said structural metal sections defining an enclosed air space together with said heat-insulating bars and said flanges being adapted to clamp the ends of said heat-insulating bars within said opposite grooves, those flanges for clamping one heat-insulating bar which are adjacent to said inner space being made longer than the flanges for clamping the other heat-insulating bar, so that when the longer flanges are bent against the one heat-insulating bar a more stronger connection is provided.

1 Claim, 2 Drawing Figures

HEAT-INSULATED STRUCTURAL SECTION ASSEMBLY

BACKGROUND OF THE INVENTION

This invention relates to a heat-insulated structural section assembly for use in manufacturing window and door frames which consists of two structural metal sections transversely connected to each other by a pair of plastic heat-insulating bars with which they define an enclosed air space. Each structural metal section has flanges integrally formed therewith, which define with the web of the section longitudinally extending grooves in which said heat-insulating bars are adapted to be clamped by said flanges.

OBJECT OF THE INVENTION

The object of the invention is to construct a structural section assembly of the above type in such a manner that a pair of flanges can be so attached that the rolling tools engage these flanges from a single direction, i.e. substantially from the direction of the window pane panel to be later set into the window or door frame.

SUMMARY OF THE INVENTION

In accordance with the invention, this object is achieved by the fact that the flanges for clamping one heat-insulating bar which are adjacent to the enclosed air space are made longer than the flanges for clamping the other heat-insulating bar.

The longer flanges are produced quite simply by slightly modifying the conventional extrusion die used to manufacture the metal structural section so as to be integrally formed therewith.

In a preferred embodiment of the invention, the longer flange of each metal structural section extends toward the opposite flange of the other metal structural section.

In a further embodiment of the invention, the longer flanges are extended outwardly over the respective contact surfaces resulting from the bending of said opposite longer flanges against said one heat-insulating bar.

The metal structural sections are made of any lightweight metal or alloy suitable for window or door frames, preferably aluminum or aluminum alloy.

The heat-insulating bars are made of any plastic material having good heat-insulating characteristics e.g. polyamides. Such plastic materials are well known to those skilled in the art.

A preferred embodiment of the invention will now be further described with reference to the accompanying drawings:

DETAILED DESCRIPTION OF THE DRAWINGS

Figure 1:
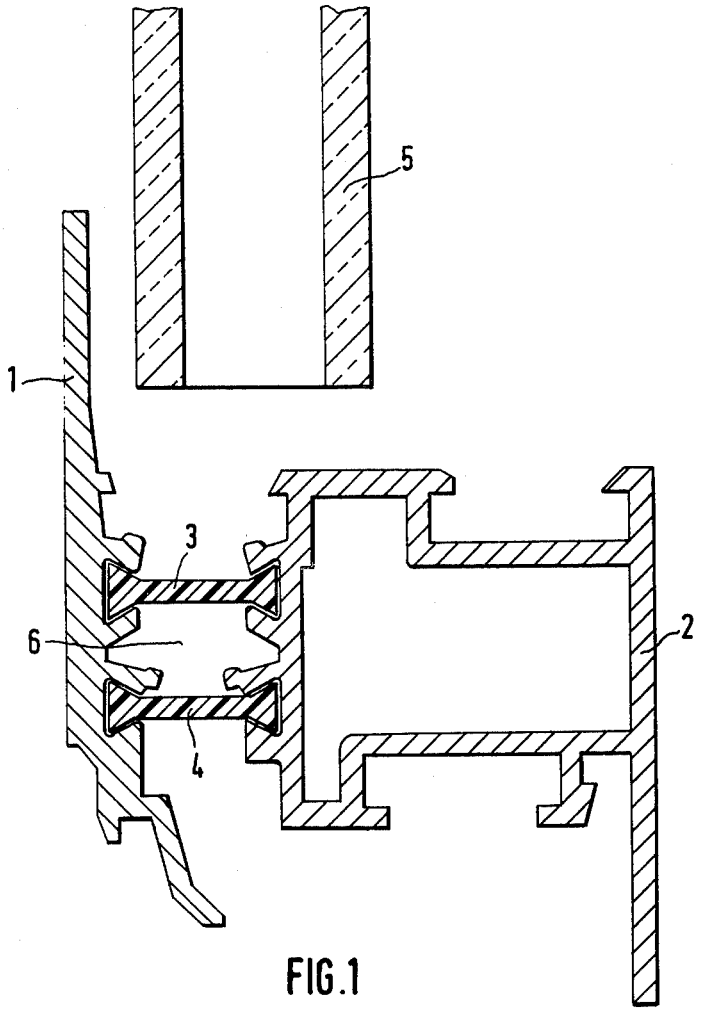
FIG. 1 shows a cross-sectional view of a finished structural section assembly of the invention, for use in manufacturing a window frame.

In FIG. 1, the structural section assembly is shown consisting of two structural metal sections 1 and 2 and a pair of plastic heat-insulating bars 3 and 4. One heat-insulating bar 3 is located adjacent to the window pane 5 to be set later into the window frame, while the other heat-insulating bar 4 is located remote from the window pane 5. Both heat-insulating bars 3 and 4 are clamped in opposed pairs of longitudinally extending grooves defined by transverse flanges 7, 8, 9, 10, and 11 (FIG. 2) integrally formed with the webs of the structural metal sections.

As shown in FIG. 1, an enclosed air space 6 is thus formed by the heat-insulating bars 3 and 4 and the structural sections 1 and 2.

Figure 2:
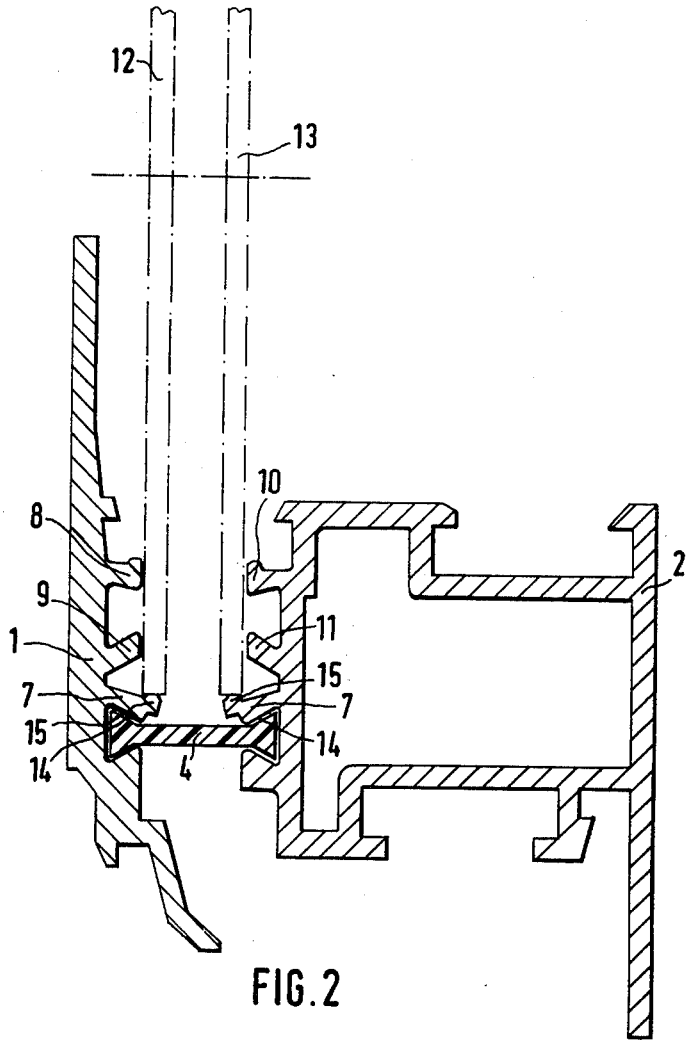
FIG. 2 shows a cross-sectional view of a structural section assembly for a window frame, in which the longer flanges of the structural metal sections are being clamped by pressure rollers against the heat-insulating bar remote from the window pane.

As shown in FIG. 2, the flanges 7 which are adapted to be bent against the lower heat-insulating bar 4 for clamping it are longer than the other flanges 8, 9, 10, and 11. It will be seen from FIG. 2 that upon bending of the flanges 7 by means of pressure rollers 12 and 13, the greater length of flanges 7 makes for an air-tight connection between metal sections 1 and 2 and heat-insulating bar 4.

Advantageously, the longer flange 7 of each metal section extends toward the opposite flange which is integral with the other structural metal section.

In a preferred embodiment of the invention, the longer flanges 7 are further extended outwardly over the respective contact surfaces 14 resulting from the bending of the opposed flanges 7 against the heat-insulating bar 4. The further extension is shown at 15 in FIG. 2. Due to this, the pressure rollers 12 and 13 act upon a lever arm, namely the extensions 15 which extend outwardly from the contact surfaces 14, thus providing a particularly strong connection.

We claim:

1. In a structural section assembly for use in manufacturing window and door frames consisting of two structural metal sections made from a metal selected from the group consisting of aluminum or aluminum alloy and having integral flanges defining opposed longitudinally extending grooves together with the webs of the respective structural metal sections, and connected to each other by a pair of plastic heat-insulating bars, said structural metal sections defining an enclosed air space together with said heat-insulating bars and said flanges being adapted to clamp the ends of said heat-insulating bars within said opposed grooves, wherein the improvement comprises the feature that the opposed flanges clamping one of the heat-insulating bars are made longer than the flanges for clamping the other heat-insulating bar, the arrangement being such that longer flanges during assembly are first bent by pressure rollers against the heat-insulating bar.

* * * * *